US008453661B2

(12) United States Patent
Hutt

(10) Patent No.: US 8,453,661 B2
(45) Date of Patent: Jun. 4, 2013

(54) SAFETY CANE STRAP

(76) Inventor: David M. Hutt, Bayside, NY (US)

( * ) Notice: Subject to any disclaimer, the term of this patent is extended or adjusted under 35 U.S.C. 154(b) by 0 days.

(21) Appl. No.: 12/402,116

(22) Filed: Mar. 11, 2009

(65) Prior Publication Data

US 2009/0229642 A1 Sep. 17, 2009

Related U.S. Application Data

(60) Provisional application No. 61/035,686, filed on Mar. 11, 2008.

(51) Int. Cl.
*A45B 3/00* (2006.01)

(52) U.S. Cl.
USPC ..... 135/66

(58) Field of Classification Search
USPC ..... 135/66, 72, 76; 224/254, 255, 267
See application file for complete search history.

(56) References Cited

U.S. PATENT DOCUMENTS

| | | | | | |
|---|---|---|---|---|---|
| 1,653,024 | A | | 12/1927 | Simek | |
| 2,493,705 | A | * | 1/1950 | Vogel | 224/578 |
| 3,113,786 | A | * | 12/1963 | Phillipson | 280/822 |
| 3,825,276 | A | * | 7/1974 | Adelmann | 280/821 |
| 4,139,210 | A | * | 2/1979 | Allsop et al. | 280/822 |
| 4,229,015 | A | * | 10/1980 | Ramsey et al. | 280/819 |
| D297,887 | S | | 10/1988 | Hattersley | |
| 4,907,614 | A | * | 3/1990 | Stamm | 135/15.1 |
| 4,958,758 | A | | 9/1990 | Tipple et al. | |
| 5,020,192 | A | * | 6/1991 | Gerlach | 24/136 R |
| 5,040,324 | A | * | 8/1991 | Rivera et al. | 43/26 |
| 5,082,156 | A | * | 1/1992 | Braun | 224/220 |
| 5,511,293 | A | * | 4/1996 | Hubbard et al. | 24/442 |
| 5,788,608 | A | | 8/1998 | Wilkinson | |
| 5,964,385 | A | | 10/1999 | Simon | |
| 5,996,602 | A | | 12/1999 | Cato, III | |
| D448,152 | S | | 9/2001 | Folise | |
| 6,550,108 | B2 | * | 4/2003 | Pratl | 24/3.13 |
| 6,726,071 | B2 | * | 4/2004 | Baseflug et al. | 224/258 |
| 6,851,437 | B1 | | 2/2005 | Lenhart | |
| 6,951,224 | B2 | | 10/2005 | Garrett | |
| 6,997,362 | B1 | * | 2/2006 | Pidcock | 224/607 |
| 2004/0163693 | A1 | | 8/2004 | Uemura | |
| 2004/0178621 | A1 | * | 9/2004 | Martin et al. | 280/819 |
| 2005/0005404 | A1 | | 1/2005 | Panizza | |
| 2009/0065538 | A1 | * | 3/2009 | Rodriquez et al. | 224/267 |
| 2009/0242007 | A1 | * | 10/2009 | Heyer et al. | 135/71 |

* cited by examiner

*Primary Examiner* — Noah Chandler Hawk
(74) *Attorney, Agent, or Firm* — Cozen O'Connor

(57) ABSTRACT

A safety strap for a cane handle portion of a cane includes a strap piece extending between a first end and a second end, a first connection arranged at the first end, and a second connection arranged at the second end, the first and second connections being connectable to the cane at opposing ends of the cane handle portion. The cane strap supports a weight of the cane when the first and second connections are connected to the cane and a user's hand is inserted between the strap and cane handle portion, so that the cane handle is maintained proximate the user's palm if the user's grip on the cane handle portion is inadvertently released. Furthermore, at least one of the first and second connections is releasable when a predetermined pulling force is exceeded, so that the cane is allowed to fall away from the user in a situation in which retaining the cane is likely to cause injury.

7 Claims, 9 Drawing Sheets

SAFETY CANE STRAP

RELATED APPLICATIONS

This application claims priority from U.S. Provisional Patent Application Ser. No. 61/035,686 which was filed on Mar. 11, 2008. The entire contents of U.S. Provisional Patent Application Ser. No. 61/035,686 is incorporated herein by reference.

BACKGROUND OF THE INVENTION

1. Field of the Invention

The present invention relates to a safety cane strap for maintaining a cane handle against a user's palm.

2. Description of the Related Art

For many people, canes are essential for mobility. However, there are many obstacles that make it difficult to maneuver with a cane. For example, there are many situations which may startle a user and cause the user to momentarily release their grip on the cane handle such as, for example, a child or dog pulling on the cane, an inadvertent kick of the cane, or the cane getting caught in a terrain feature. When this happens, the cane can fall from the user in an instant. For the elderly and infirm, a lost or dropped cane can be extremely difficult or impossible to retrieve.

Wrist straps, which have one end connected to the cane, are employed to maintain the cane in close proximity to the user. Examples of such straps are disclosed, for example, in U.S. Pat. No. 4,958,758 and U.S. Pat. No. 5,964,385. While such straps help keep the cane in the vicinity of the user, it is still difficult to get the cane back into the user's grip quickly after the cane has been released because the cane hangs from the user's wrist.

Furthermore, some wrist straps have a safety release feature that allows detachment of the wrist strap. An example of this is described in US Patent App. Pub. No. 2005/0005404. However, the known wrist straps with the safety release feature have the same problem as the wrist straps mentioned above. That is, it is still difficult to get the cane back into the user's grip quickly after the cane has been released because the cane hangs from the user's wrist.

SUMMARY OF THE INVENTION

An object of the present invention is to provide a strap that can be fitted to an existing cane and which maintains the cane handle proximate a user's palm in the event that the user's grip is loosened.

The object of the present invention is met by a safety strap for a cane handle portion of a cane, including a strap piece extending between a first end and a second end, a first connection arranged at said first end, and a second connection arranged at said second end, said first and second connections being connectable to the cane at opposing ends of the cane handle portion to form a closed loop with the cane through which a user's hand is insertable. The cane strap supports a weight of the cane when the first and second connections are connected to the cane and a user's hand is inserted between the strap and cane handle portion, whereby the cane handle is maintained within the grasp of the user's hand if the user's grip on the cane handle portion is inadvertently released. Furthermore, at least one of the first and second connections is releasable when a predetermined force is exceeded, whereby the cane is allowed to fall away from the user in a situation in which retaining the cane is likely to cause injury.

The safety strap can be retrofitted onto existing canes.

The object of the present invention is met by a combination of a safety strap and a cane having a cane handle portion, the safety strap including a strap piece extending between a first end and a second end, a first connection arranged at the first end, and a second connection arranged at the second end. The first and second connections are connected to the cane at opposing ends of the cane handle portion to form a closed loop with the cane through which a user's hand is insertable. The cane strap supports a weight of the cane when the first and second connections are connected to the cane and a user's hand is inserted between the strap and cane handle portion, whereby the cane handle is maintained within the grasp of the user's hand if the user's grip on the cane handle portion is inadvertently released. Furthermore, at least one of the first and second connections is releasable when a predetermined force is exceeded, whereby the cane is allowed to fall away from the user in a situation in which retaining the cane is likely to cause injury.

The object of the invention is also met by a method of assembling a safety strap for retrofit onto a cane, including providing an elastic cord having first and second ends, determining the characteristics of the cane on which the safety strap will be applied, determining the first and second connections required based on the determined cane characteristics, assembling the first connection on the first end of the cord, sliding a sleeve over the second end of the cord, and assembling the second connection on the second end of the cord.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like references denote similar elements throughout the several views.

DETAILED DESCRIPTION OF THE PRESENTLY PREFERRED EMBODIMENTS

Figure 1:
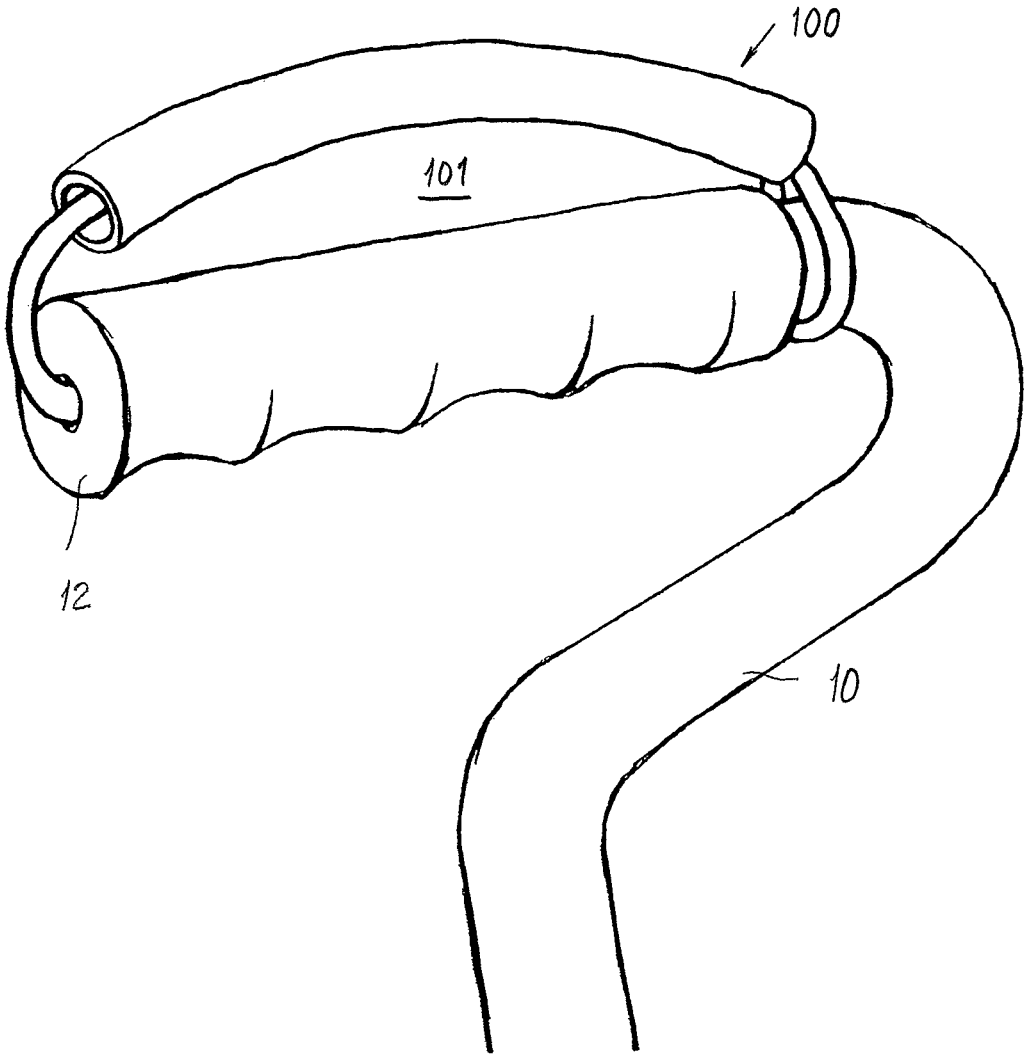
FIG. 1 is a perspective view of a first embodiment of a safety strap according to the present invention.
Figure 2:
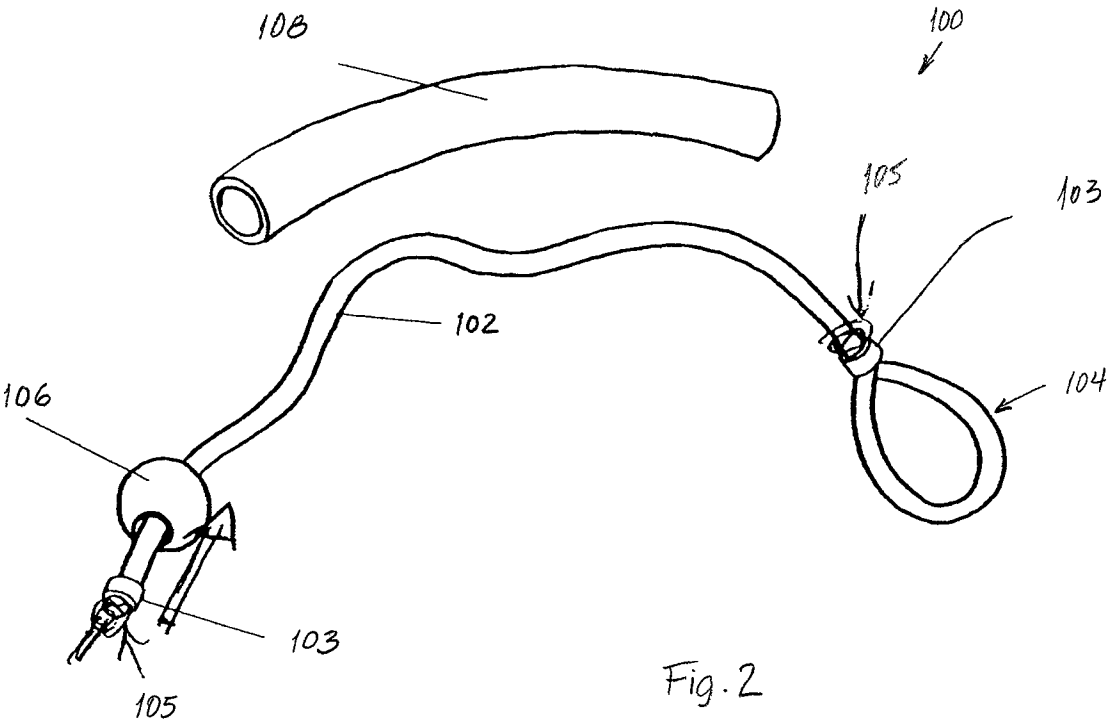
FIG. 2 is a view of the elements of the safety strap of FIG. 1 prior to assembly.

FIG. 1 is a perspective view showing a safety strap 100 installed on a cane 10. The strap 100 and cane 10 define a closed loop enclosing a space 101 therebetween in which the user places his/her hand when using the cane. In this particular embodiment, the cane 10 includes a rubber or plastic handle 12. FIG. 2 shows the parts of the safety cane strap 10. An elastic cord 102 approximately 10 inches long has a loop 104 at one end. The loop 104 may be tied using a knot 105 and/or held in place by a clip 103. The clip may, for example, include a crimping sleeve such as those used for fishing tackle. The other end of the elastic cord 102 has a plastic bead 106 inserted thereon with a knot and/or clip on the end for holding the bead onto the elastic cord. The safety cane strap 100 also has a length of tubing arranged between the bead 106 and the loop 104. Although the preferred embodiments shown in FIGS. 1 and 2 use knots and/or pressure clips, any other know or hereafter developed connection method or connection device may be used to hold the loop 104 and bead 106 in place.

To assemble the safety strap, the elastic cord 102 is first configured at one end to form the loop 104, which is about one inch in diameter. The loop is secured by the knot and/or the pressure clip 103. The elastic cord 102 is then drawn through the sleeve 108 until the knot and/or clip holding the loop is in the sleeve. An adhesive such as a rubber cement or other adhesive may be applied to the knot and/or clip 103 in the sleeve 108 so that the knot and/or clips stays inside the sleeve during use. The bead 106 is then placed over the free end of the elastic cord 102. Another knot and/or clip 103 is used to maintain the bead 106 on the cord 102.

Figure 3:
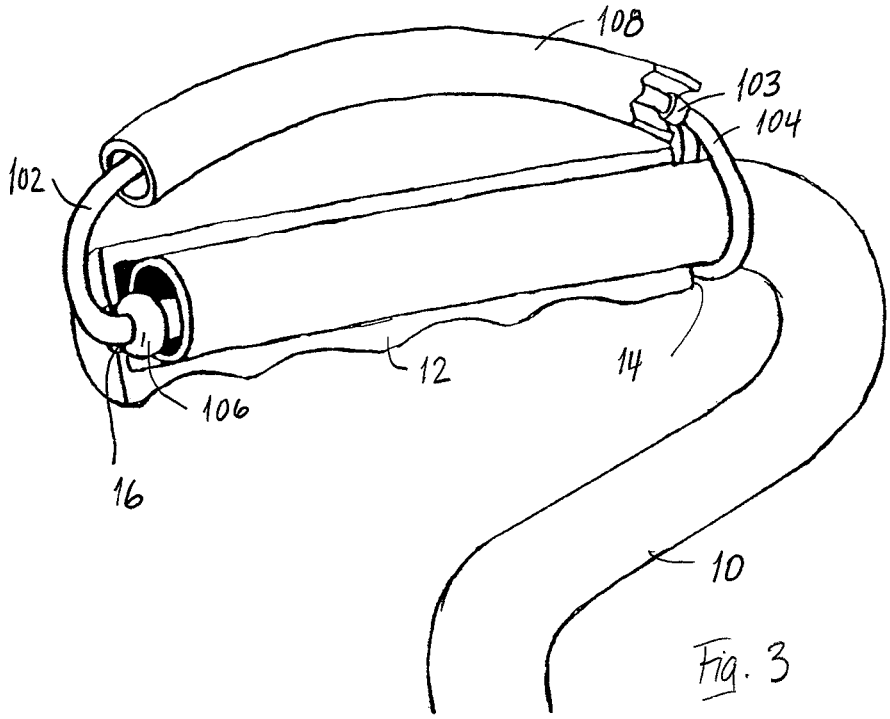
FIG. 3 is a partial cutaway view of the safety strap of claim 1 connected to a cane.

The safety strap 100 is placed on the cane as follows. The loop 104 is fitted over the cane handle 12 so that the loop 104 is wrapped around the cane material (see FIG. 3). The loop is braced against a shoulder 14 formed by an end of the handle 12. The bead 106 is then inserted through a hole 16 at the free end of the handle 12. The bead 106 is slightly larger than the hole so an elastic deformation of the bead and/or the hole occurs as the bead is pushed through the hole. As described in more detail below, the bead 106 is held firmly in the handle so that the strap 100 will support the weight of the cane but will release when a predetermined release tension is reached. Thus, the strap 100 can be installed on the cane 10 with minimal effort and does not require any tools. Furthermore, the strap can be retrofit onto existing canes. Moreover, if a user is replacing his/her cane, the safety strap can be moved from the old cane to the new cane.

Figure 5:
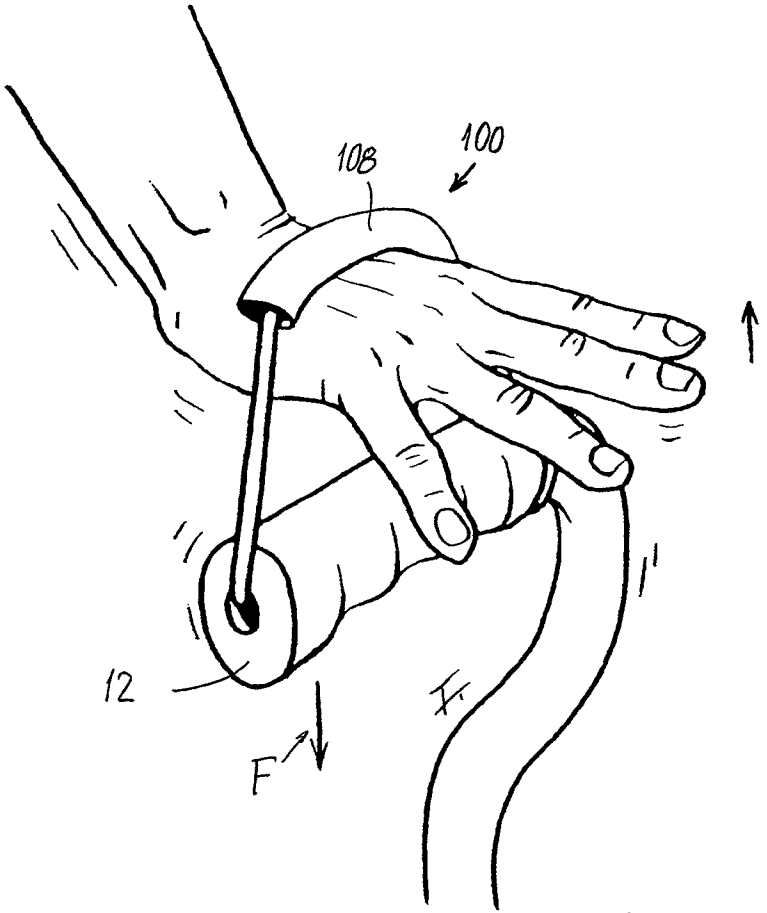
FIG. 5 is a perspective view of the strap of FIG. 1 when a user has lost his/her grip.
Figure 4:
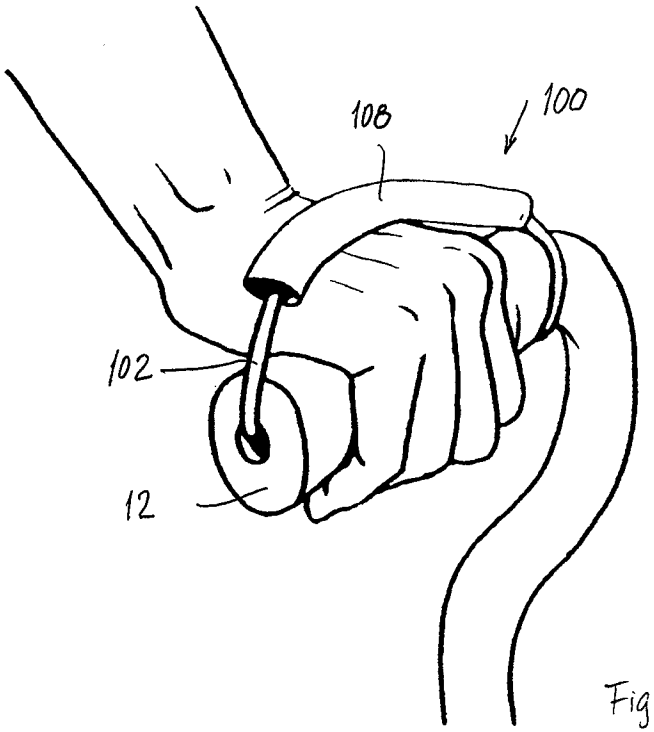
FIG. 4 is a perspective view of the strap of FIG. 1 during normal use.
Figure 6:
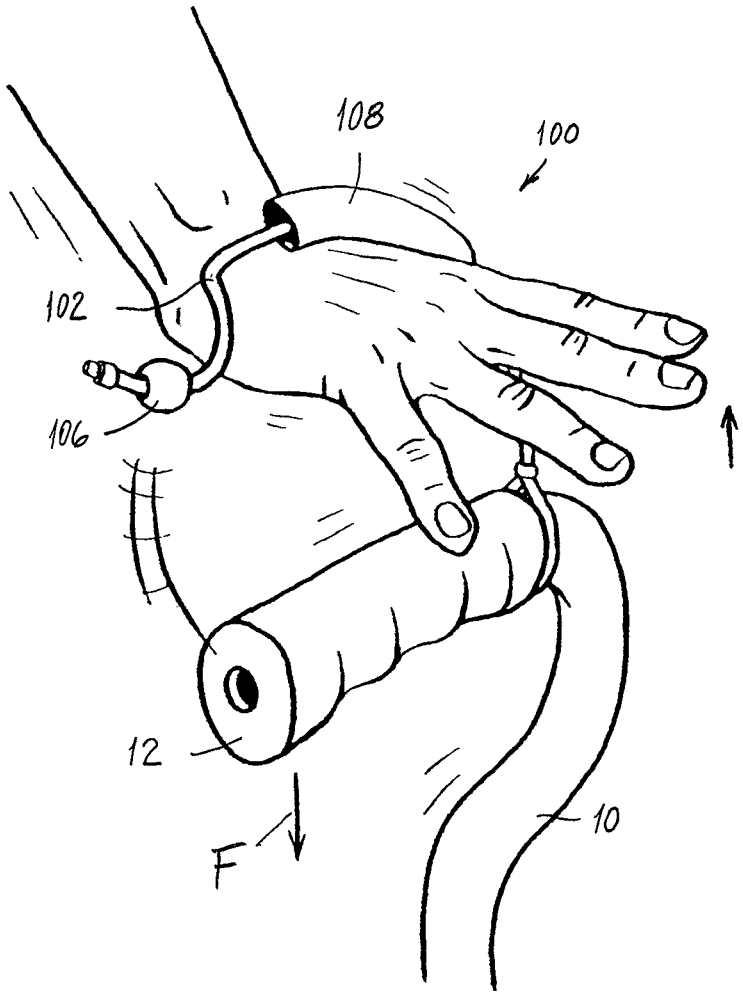
FIG. 6 is a perspective view of the strap of FIG. 1 illustrating the safety release feature.

FIGS. 4-6 illustrate the function of the safety cane strap. FIG. 4 depicts the normal position in which a user's hand grasps the cane handle. The safety strap 100 lays over the top of the user's hand. Here, the elastic is not stretched or is only minimally stretched so that very little pressure is put on the back of the user's hand to avoid hindering circulation in the user's hand during normal use.

FIG. 5 illustrates the situation after the user has lost his/her grip of the handle and the cane is being pulled away by an external force F acting on the cane. In this situation, the elastic urges the cane back toward the user's hand. Furthermore, the sleeve 108 over the elastic cord 102 prevents the elastic from rubbing the skin of the user as the elastic stretches and therefore prevents rashes or burns. The construction is designed to maintain the cane in the user's hand even if the user is startled and loosens his/her grip on the cane because of, for example, a child or dog pulling on the cane, an unintentional kick of the cane, or the cane getting stuck in a terrain feature.

As mentioned above, FIG. 5 shows the cane being pulled away from the user hand in response to an external force F acting on the cane. However, if no external force is present and the user has merely opened his/her grip on the cane, the weight of a typical medical hollow aluminum cane or wooden cane will not cause the elastic cord 102 to stretch and the cane handle will not be pulled away from the user's hand. Thus, in that case, the user can simply tighten his/her grip to immediately grasp and regain control of the cane.

FIG. 6 illustrates the safety release feature of the safety strap 100. In some situations, it is better to release the cane strap 100 from the cane 10 to avoid injury to the user such as, for example, if the cane is stuck in a car door or bus door. Thus, the safety release feature allows the cane to fall away or be carried away in instances when the cane may cause injury to the user. In one embodiment, the safety release is designed to release the cane when a force F pulling the cane away from the strap is five pounds or greater. In other embodiments, the minimum release force is 7 or 10 pounds or more. The force F is chosen as a balance between the two competing goals of maintaining the cane proximate the user's palm so that control of the cane can be regained by closing the user's hand and releasing the cane from the user's hand to avoid injury. Thus, the force F for safety release may be designed to be different for users of different strength and/or weight. Varying the safety release force may, for example, be accomplished by using different sized beads 106.

Figure 7B:
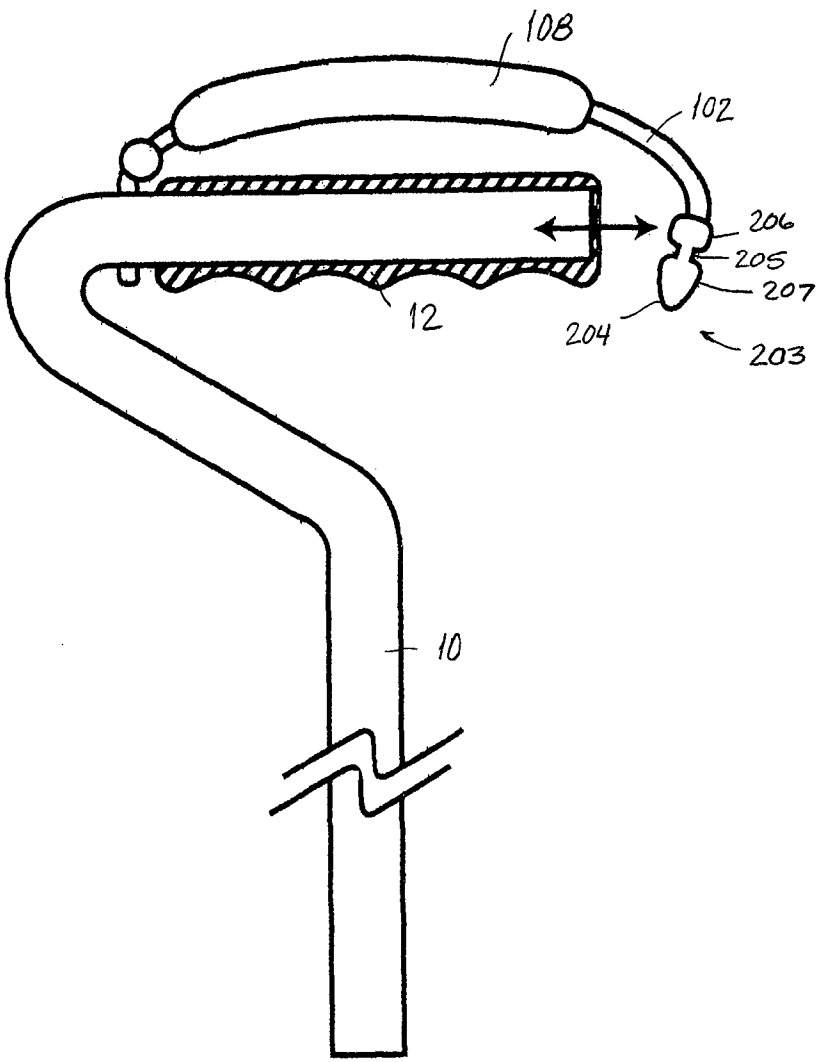
FIGS. 7*a* and 7*b* are cutaway view of a further embodiment of the safety strap.
Figure 7A:
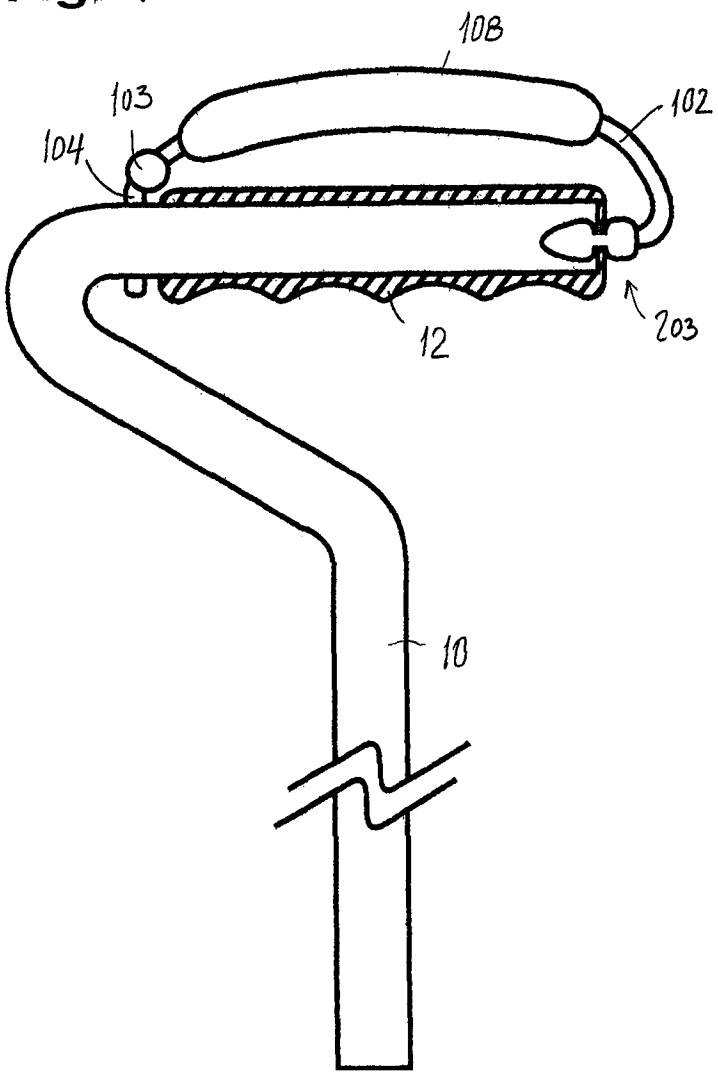

FIGS. 7*a* and 7*b* show an alternative embodiment in which a molded rubber or plastic retainer piece 203 is either molded directly onto an end of the elastic cord 102 or glued thereon. The retainer piece 203 includes a conical front end 204 which facilitates insertion into the hole in the handle 12. Additionally, the retainer piece 203 has a central area 205 of small diameter surrounded by areas 206, 207 of larger diameter. Instead of the bead 106 or the retainer piece 203, any other retainer, which is insertable into the hole of the cane handle 12, may alternatively be used.

Figure 8:
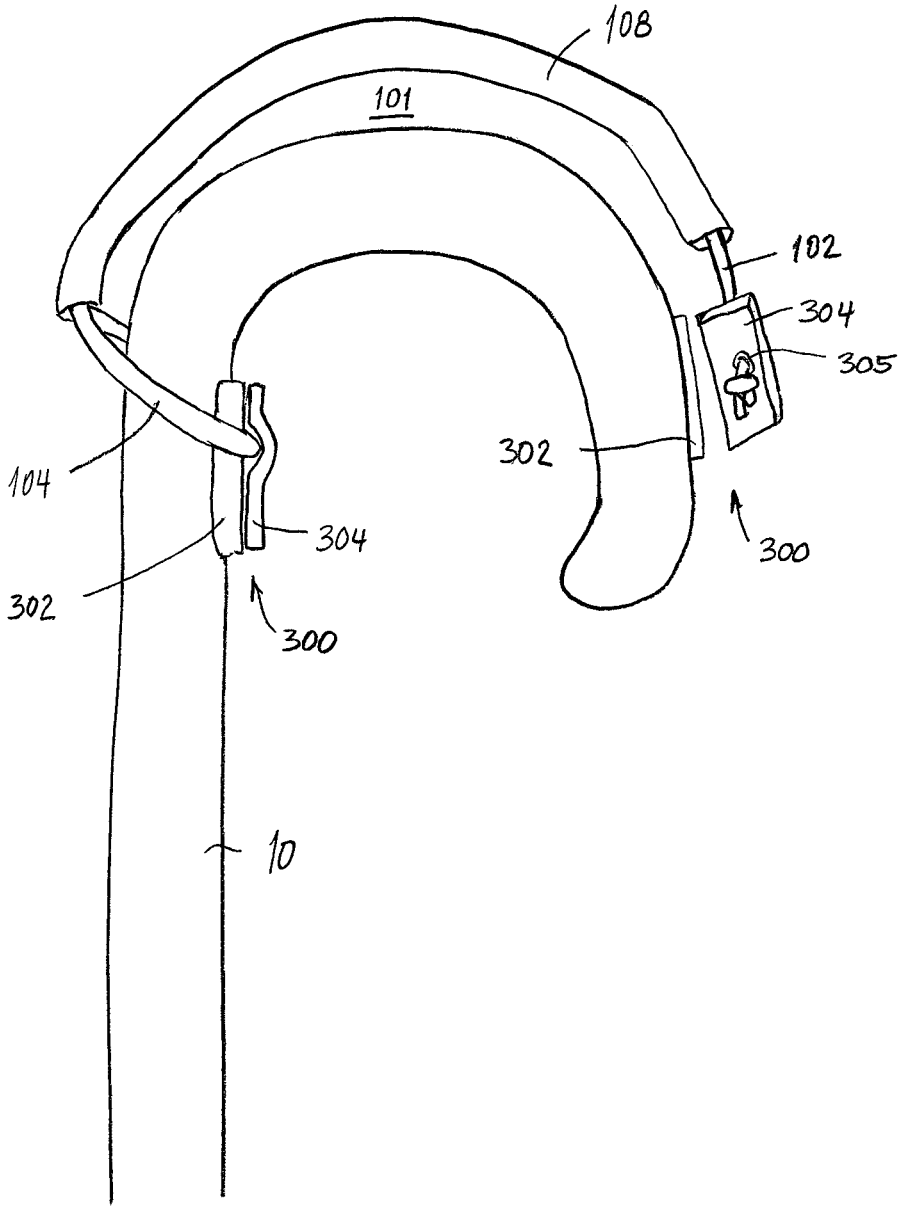
FIG. 8 is a side view of a further embodiment of the present invention applicable to a wooden cane with a round handle.

For canes that do not have a rubber handle 12, such as wooden or hollow aluminum canes with curved handles, the embodiment of the cane strap in FIG. 8 may be used. In this case, hook and loop fasteners 300, such as VELCRO, or similar fasteners may be used to attach the cane strap to opposing sides of a handle portion (i.e., the portion of the cane that is normally held by a user during use). In this embodiment, the loop 104 is slid over the cane until the loop 104 is on a first part 302 of the hook and loop type fastener which has been adhered to the cane. A second part 304 of the hook and loop fastener is placed over the first part 302 to hold the loop 104 on the cane. At the other end of the safety strap, a first part of the hook and loop fastener is adhered to the cane and the end of the elastic cord is threaded through a hole in the second part 304. A knot 305 is made to retain the second part 304 on the elastic cord. The second part 304 is then placed on the first part 302 to hold the safety strap in place. The hook and loop fasteners 300 may be relied on to effect the safety release described above with reference to FIG. 6. That is, the release of the second part 304 from the first part 302 may effect the safety release. Alternatively, the safety release may rely on the release of the knot 305 from the second part 304. The hook and loop fastener 300 may also be used to hold the loop 104 in the embodiment of FIGS. 1-3 onto the cane.

Figure 9:
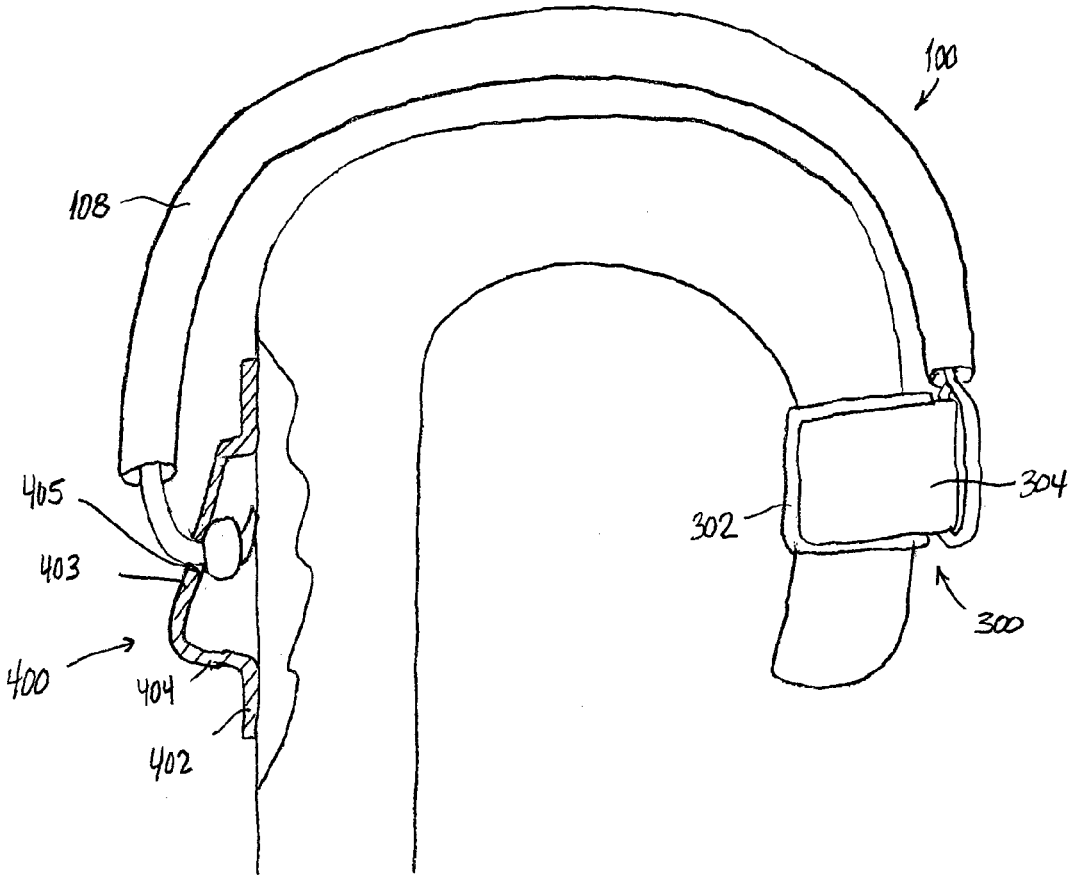
FIG. 9 is a partial cutaway view of a further embodiment of the safety strap of the present invention.

Instead of relying on the hook and loop fastener to effect the safety release, another fastener may be connected at one end of the cane strap. FIG. 9 shows a safety strap 100 as in FIGS. 1-3 connected to a wooden cane. The loop 104 is held onto the hook and loop fastener 300. A bead 106 on the other end of the safety strap is connected in a hole 405 of a cup-shaped connector 400. The cup-shaped connector has a flange 402 that is connected by adhesive to the cane. Although the present embodiment uses adhesive, any other connection method may alternatively be used. For example, the flange could have holes for receiving fasteners such as screws or nails. The cup-shaped portion also has sidewalls 404 and a bottom 403 in which hole 405 is formed. The bead 106 is placed through the hole 405 and held therein until a predefined tension is reached as described above. As shown in FIG. 9, the bottom 403 of the cup-shaped connector is inclined relative to the cane so that the bottom faces upward at least slightly. This inclination of the bottom 403 facilitates the proper safety release of the bead 106.

Figure 10:
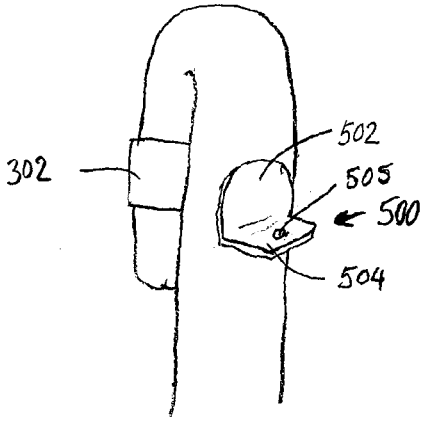
FIG. 10 is a front view of yet another embodiment of the safety strap of the present invention.

FIG. 10 shows yet another connector 500 which can be connected to the cane to hold an end of the elastic cord with a bead. In this embodiment, the connector 500 is an L-shaped piece having a first leg 502 against the cane and a second leg 504 projecting from the cane and defining a hole 505 therein for receiving the bead 106. In this embodiment, the second leg 504 projects approximately normal to a longitudinal axis of the cane. However, the second leg could project at any angle deemed appropriate to effect the safety release feature.

Figure 11:
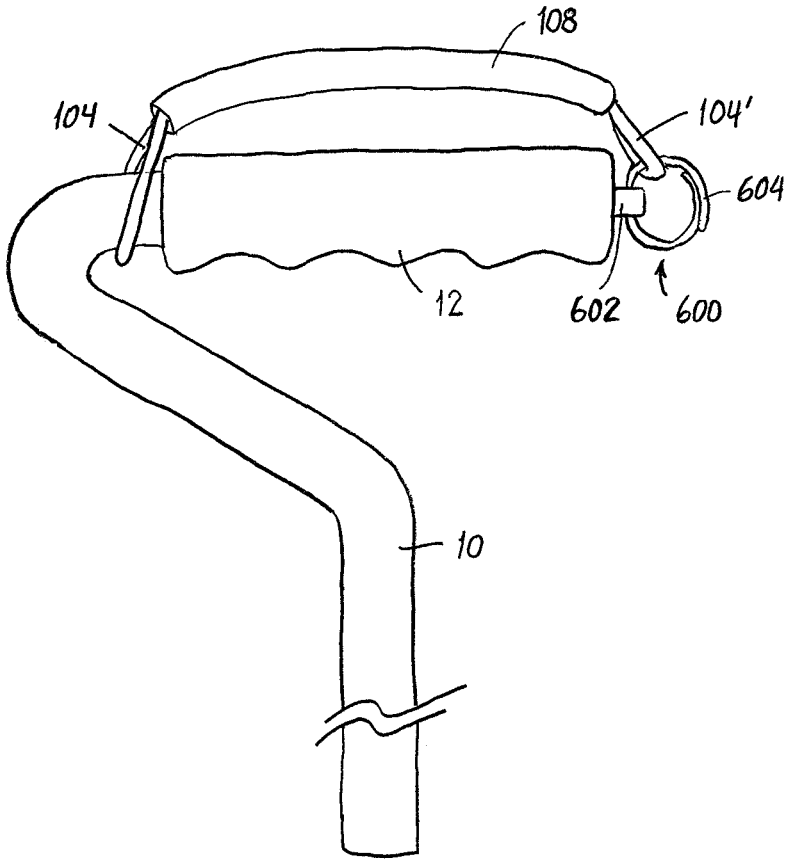
FIG. 11 is a side view of still another embodiment of the safety strap according to the present invention.

FIG. 11 shows still another embodiment in which a ring connector 600 is connected in a hole at the end of the handle 12 of the cane 10. The ring connector includes a connector piece 602 and an overlapping ring 604. The connector piece 602 may, for example, include a shape similar to the connector piece 203 shown in FIGS. 7*a* and 7*b* and described above. The connector piece could have any other shape that is insertable in the hole, wherein the connector piece and/or the hole are deformable to release the connector piece for the safety release feature as described above. In the embodiment of FIG. 11, the safety strap includes the loop 104 at one end of the elastic cord 102 and a second loop 104' at the second end of the elastic cord 102. The first loop 104 is connected to the cane in the same manner as described above. The second loop 104' is connected to the overlapping ring 604 using, for example, the conventional method for attaching tags to overlapping rings.

The safety strap having two loops 104, 104' disclosed in FIG. 11 can be used without the key ring. In such an embodiment, each of the loops 104, 104' is attached to the cane using any of the connection methods for loops described above. Furthermore, a safety strap embodiment having only beads and/or knots on both ends may also be used. Any of the connection methods described above pertaining to knots and/or beads may be employed in such embodiments.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A safety strap for connection to a cane handle of a cane, the cane handle having a first cane handle end connected to the cane and a second cane handle end being a free end with a predetermined connection configuration, the first and second cane handle ends being disposed at opposing ends of the cane handle, said safety strap comprising:

a strap including an elastic cord and having a first end and a second end;

the elastic cord being curved around and connected to form a first loop at said first end of said strap, wherein the first loop comprises a first connection element, the first loop being expandable so that the first loop can fit over the second cane handle end and receive the handle therethrough to be positioned proximate the first cane handle end of the cane handle; and a second connection element arranged at said second end of said strap, said first and second connection elements configured to connect to the cane proximate the first and second cane handle ends of the cane handle to form a closed loop with the cane handle through which a user's hand is insertable, wherein the strap is configured to support a weight of the cane and to urge the cane handle against the user's hand when the first and second connection elements are connected proximate the first and second cane handle ends of the cane handle and a user's hand is inserted between the strap and the cane handle, so that the cane handle can be maintained proximate the user's palm if the user's grip on the cane handle is inadvertently released, whereby the user can regrasp the cane handle to regain control of the cane after inadvertently releasing a grip on the cane handle, and wherein the predetermined connection configuration comprises an opening at the second cane handle end, and the second connection element includes a ring connected to the second end of said strap and a connector piece connected to said ring, said connector piece being insertable into the opening to connect the strap to the second cane handle end and to be releasable from the second cane handle end, said second connection element is configured to be connected to the predetermined connection configuration of the cane proximate the second cane handle end of the cane handle and releasable therefrom when a predetermined pulling force on the cane is exceeded, whereby the cane is allowed to fall away from the user in a situation in which retaining the cane is likely to cause injury.

2. The safety strap of claim 1, wherein the strap is elastic, thereby accommodating hands of various sizes.

3. The safety strap of claim 1, further comprising a sleeve surrounding at least a portion of the strap between the first and second ends.

4. The safety strap of claim 1, wherein the predetermined force corresponds to when a five pound pulling force is exerted on the cane in a direction away from the handle.

5. The safety strap of claim 1, wherein a pulling force is exerted on said second connection element in a first direction when the first and second connection elements are connected to the cane proximate the first and second cane handle ends and the user's hand is inserted between the strap and the cane handle, wherein the connection of the second connection element is maintained when the pulling force is not greater than a predetermined value in the first direction and the second connection element is configured to release from the predetermined connection configuration when the pulling force in the first direction exceeds the predetermined value.

6. A combination comprising a safety strap and a cane having a cane handle with a first cane handle end connected to the cane and a second cane handle end being a free end of the cane handle, the safety strap comprising:

a strap including an elastic cord and extending between a first end and a second end, said strap and said cane handle being separate components;

the elastic cord being curved around and connected to form a first loop at said first end of said strap, the first loop comprising a first connection element and being configured so that the first loop is expandable to fit over the second cane handle end and receive the cane handle therethrough to be positioned proximate the first cane handle end; and a second connection element arranged at said second end of said strap, said first and second connection elements being respectively connected to the cane proximate the first and second cane handle ends of the cane handle to form a closed loop with the cane through which a user's hand is insertable, wherein the strap supports a weight of the cane and urges the cane handle against the user's hand when the first and second connection elements are connected proximate the first and second cane handle ends of the cane handle and a user's hand is inserted between the strap and cane handle, whereby the cane handle is maintained proximate the user's palm if the user's grip on the cane handle is inadvertently released, and wherein the second connection element is releasable when a predetermined pulling force on the cane is exceeded, whereby the cane is allowed to fall away from the user in a situation in which retaining the cane is likely to cause injury.

7. The safety strap of claim 6, wherein the second cane handle end defines an opening, and the second connection element includes a ring connected to the second end of said strap and a connector piece connected to said ring, said connector piece being insertable into the opening to connect the strap to the second cane handle end.

* * * * *